US010759566B2

(12) United States Patent
Czerwinski et al.

(10) Patent No.: US 10,759,566 B2
(45) Date of Patent: Sep. 1, 2020

(54) MODULAR INTERCHANGEABLE VESSEL SYSTEM ACCEPTING A PLURALITY OF ATTACHMENTS

(71) Applicant: Vapur, Inc., Oxnard, CA (US)

(72) Inventors: David J. Czerwinski, Thousand Oaks, CA (US); Brent A. Reinke, Newbury Park, CA (US)

(73) Assignee: VAPUR, INC., Oxnard, CA (US)

( * ) Notice: Subject to any disclaimer, the term of this patent is extended or adjusted under 35 U.S.C. 154(b) by 0 days.

(21) Appl. No.: 16/297,469

(22) Filed: Mar. 8, 2019

(65) Prior Publication Data

US 2019/0269228 A1 Sep. 5, 2019

Related U.S. Application Data

(63) Continuation-in-part of application No. 15/659,512, filed on Jul. 25, 2017, now abandoned.

(60) Provisional application No. 62/366,490, filed on Jul. 25, 2016.

(51) Int. Cl.

| | |
|---|---|
| ***A45F 3/20*** | (2006.01) |
| ***B65D 1/02*** | (2006.01) |
| ***B65D 25/48*** | (2006.01) |
| ***B65D 75/00*** | (2006.01) |
| ***B65D 35/46*** | (2006.01) |
| ***B65D 47/06*** | (2006.01) |

(52) U.S. Cl.

CPC ..... *B65D 25/48* (2013.01); *A45F 3/20* (2013.01); *B65D 1/0292* (2013.01); *B65D 35/46* (2013.01); *B65D 47/06* (2013.01); *B65D 75/008* (2013.01); *B65D 2517/0049* (2013.01)

(58) Field of Classification Search

CPC ..... B65D 1/0292; B65D 25/48; B65D 2517/0049; B65D 35/46; B65D 47/06; B65D 75/008; A45F 3/20

USPC ..... 222/92–107

See application file for complete search history.

(56) References Cited

U.S. PATENT DOCUMENTS

| | | | | |
|---|---|---|---|---|
| 4,436,125 | A * | 3/1984 | Blenkush | F16L 37/0841 137/797 |
| 5,033,777 | A * | 7/1991 | Blenkush | F16L 37/0841 285/317 |
| 5,607,087 | A * | 3/1997 | Wery | B67D 1/0456 222/401 |
| 5,722,573 | A | 3/1998 | Camel | |
| 5,816,457 | A | 10/1998 | Croft | |
| 5,845,943 | A * | 12/1998 | Ramacier, Jr. | F16L 37/0841 285/12 |
| 6,231,089 | B1 * | 5/2001 | DeCler | F16L 37/0841 285/308 |
| 6,612,466 | B1 * | 9/2003 | Malin | B29C 65/18 222/107 |
| 6,722,533 | B2 | 4/2004 | Skillern | |
| 6,860,406 | B2 * | 3/2005 | Kobetsky | B29C 65/18 222/92 |
| 6,908,015 | B2 | 6/2005 | Choi et al. | |

(Continued)

*Primary Examiner* — Paul R Durand
*Assistant Examiner* — Andrew P Bainbridge
(74) *Attorney, Agent, or Firm* — Gates & Cooper LLP

(57) ABSTRACT

A modular interchangeable vessel system is disclosed, which comprises a flexible and flat-foldable waterproof vessel having a sealed end and an unsealed end disposed distal from the sealed end, the unsealed end having a kayak shaped endpiece sealingly coupled thereto.

8 Claims, 22 Drawing Sheets

(56) References Cited

U.S. PATENT DOCUMENTS

| | | | | |
|---|---|---|---|---|
| 7,311,231 | B2 * | 12/2007 | Noell | A45F 3/20 215/388 |
| 7,806,300 | B1 | 10/2010 | Noell et al. | |
| 8,764,068 | B2 * | 7/2014 | Frick | F16L 37/0841 285/317 |
| 9,016,505 | B2 * | 4/2015 | Canegallo | B65D 51/226 220/277 |
| 9,157,560 | B2 * | 10/2015 | Rehder | F16L 37/0841 |
| 9,506,590 | B2 * | 11/2016 | Wilhelm | A45F 3/00 |
| 2004/0256424 | A1 * | 12/2004 | Johnson | B65D 77/067 222/518 |
| 2005/0001425 | A1 * | 1/2005 | deCler | F16L 37/0841 285/305 |
| 2005/0012330 | A1 * | 1/2005 | Schmidt | F16L 37/0841 285/317 |
| 2005/0072804 | A1 | 4/2005 | Brown | |
| 2006/0049372 | A1 * | 3/2006 | Lien | A45F 3/20 251/7 |
| 2007/0075094 | A1 * | 4/2007 | Brown | A45F 3/20 222/175 |
| 2007/0108158 | A1 * | 5/2007 | Stribling | A45F 3/20 215/389 |
| 2010/0072232 | A1 | 3/2010 | Rider | |
| 2013/0161350 | A1 | 6/2013 | Murrieta | |
| 2013/0186906 | A1 | 7/2013 | Underhill | |
| 2017/0121168 | A1 * | 5/2017 | Johnson | B65D 75/5877 |
| 2017/0225852 | A1 * | 8/2017 | Ohkubo | B65D 75/44 |
| 2019/0269228 | A1 * | 9/2019 | Czerwinski | B65D 75/008 |

* cited by examiner

MODULAR INTERCHANGEABLE VESSEL SYSTEM ACCEPTING A PLURALITY OF ATTACHMENTS

CROSS-REFERENCE TO RELATED APPLICATIONS

This application is a continuation-in-part of U.S. patent application Ser. No. 15/659,512, entitled "MODULAR INTERCHANGEABLE VESSEL SYSTEM ACCEPTING A PLURALITY OF ATTACHMENTS," by David Czerwinski and Brent Reinke, filed Jul. 25, 2017, which application claims benefit of U.S. Provisional Patent Application No. 62/366,490, entitled "MODULAR INTERCHANGEABLE VESSEL SYSTEM ACCEPTING A PLURALITY OF ATTACHMENTS," by David Czerwinski and Brent Reinke, filed Jul. 25, 2016, both of which applications are hereby incorporated by reference herein.

BACKGROUND

1. Field

The present disclosure relates to systems and methods for storing and dispensing water and other consumable liquids, and in particular to a modular interchangeable flexible vessel such as a water bottle, jug, or reservoir system incorporating a unique fitment that quickly and easily accepts a plurality of attachments and a method for using same.

2. Description of the Related Art

Personal hydration is an important health consideration for people of all ages and activity levels. Convenient and effective hydration is especially important to those leading active lifestyles Unfortunately, many personal hydration products are typically designed for a specific activity, and are incompatible or unpractical for other active uses. For example, many people engaged in active lifestyles own rigid water bottles for use while at the gym, running, traveling, or biking. The same user may prefer consuming water from a soft reservoir with a drink tube stored inside of a pack for backpacking, hiking, trail running, snowboarding, skiing, hunting, and paddle sports While effective for their purpose, larger size soft reservoirs cannot practically be used as handheld water bottles for other sporting activities as they are not designed to retain their shape, are not self-supporting, and cannot be easily drank from without the entire personal hydration apparatus. Rigid water bottles on the other hand cannot be practically used as hydration reservoirs due to their bulky rigid shape and size. Further, many users engaged in active lifestyle prefer different drinking cap, closure and spout systems for each activity. For example, a user may prefer using a "bite valve" one handed cap system for running and a secure high flow two hand cap for use during travel and/or hiking.

What is needed is a single system and method that is adaptable, by use of accessories and attachments to provide personal hydration for a wide variety of active lifestyles and activities. Such a system and method is disclosed herein.

SUMMARY

A modular interchangeable vessel system, including: a flexible and flat-foldable waterproof vessel having a sealed end and an unsealed end disposed distal from the sealed end, the unsealed end having a kayak shaped endpiece sealingly coupled thereto, the kayak-shaped endpiece having a kayak aperture extending therethrough along a kayak aperture longitudinal axis, the kayak aperture having a circular cross section and a kayak threaded surface parallel to the kayak aperture longitudinal axis; a socket, including: a body, having a first male portion having a first male portion longitudinal axis, the first male portion coaxially insertable in the kayak aperture, the first male portion having a male portion threaded surface for sealingly engaging the first threaded surface; a second male portion, sealingly coupled to the first male portion, the second male portion extending longitudinally and coaxially through the first male portion, the second male portion having a female aperture portion extending longitudinally and coaxially through the second male portion. The modular interchangeable vessel system also includes a latch, slidably coupled to the second male portion, the latch slidably movable to occultationally reduce a cross section of a portion of the female aperture portion.

BRIEF DESCRIPTION OF THE DRAWINGS

Referring now to the drawings in which like reference numbers represent corresponding parts throughout.

DESCRIPTION

In the following description, reference is made to the accompanying drawings which form a part hereof, and which is shown, by way of illustration, several embodiments. It is understood that other embodiments may be utilized and structural changes may be made without departing from the scope of the present disclosure.

Figure 1:
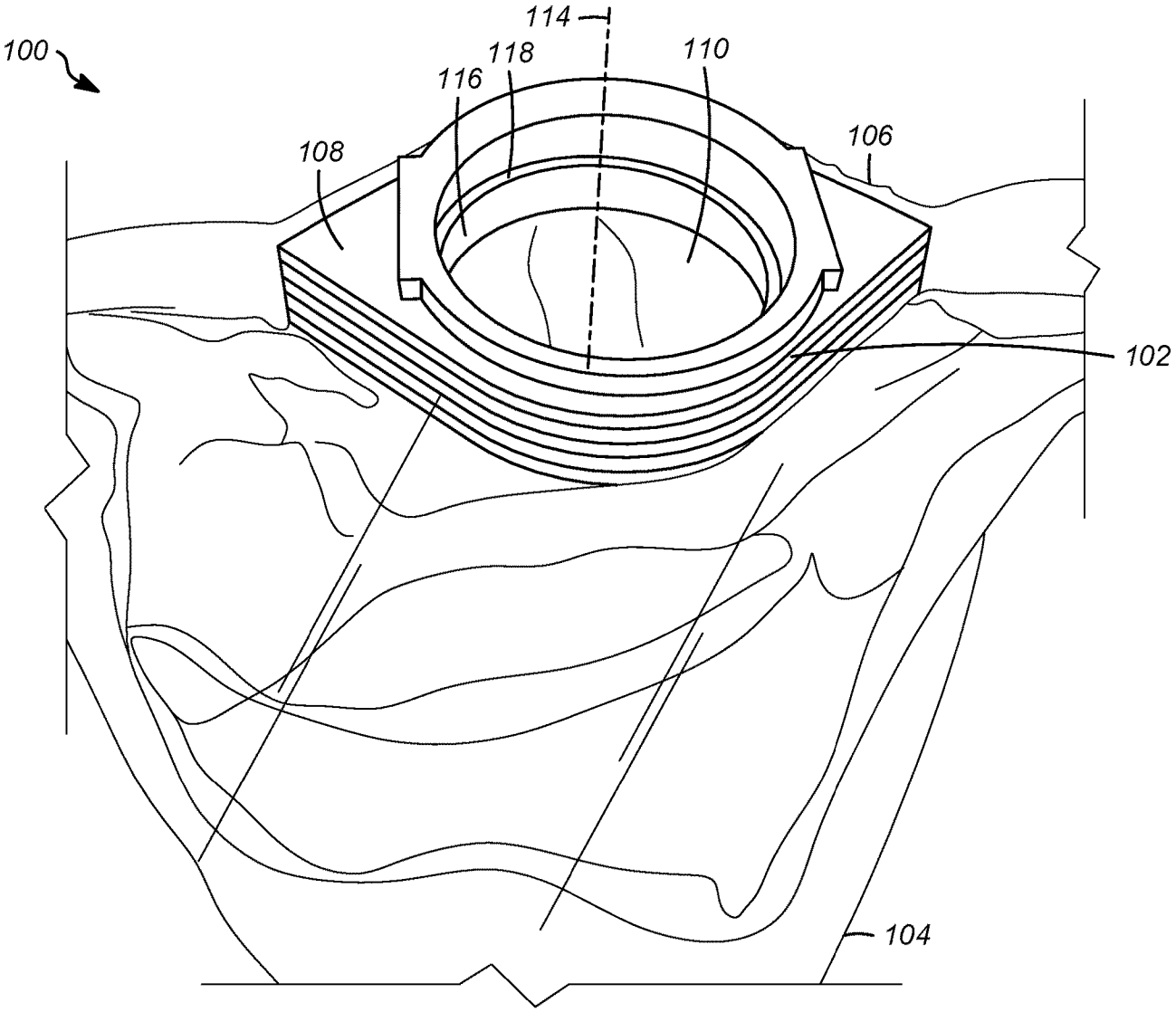
FIG. 1 is a diagram illustrating one embodiment of a flexible and flat-foldable water vessel.
Figure 2A:
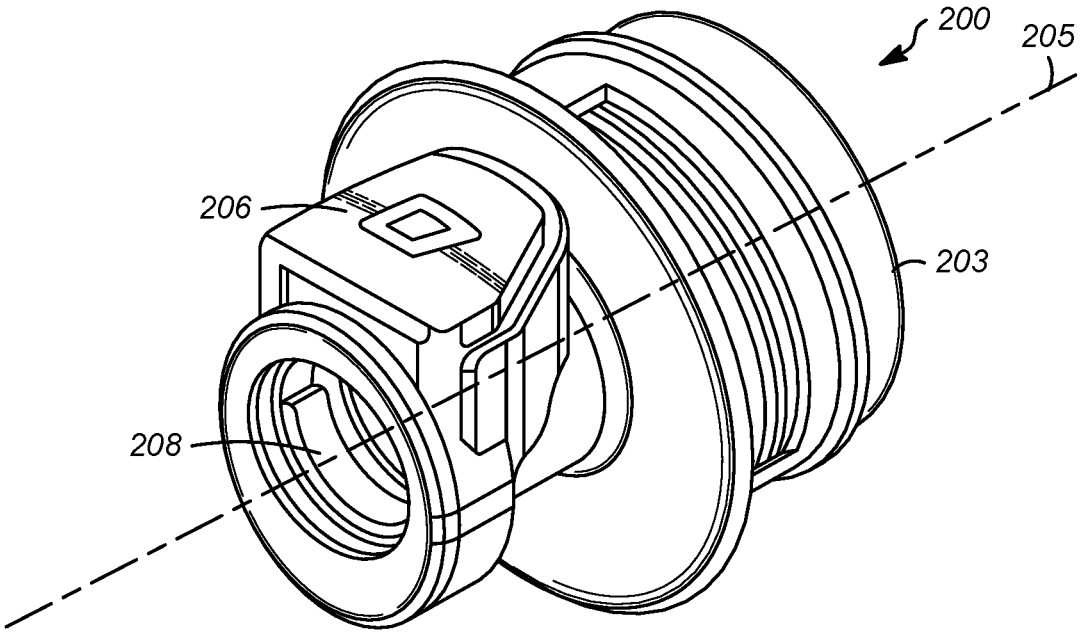
FIGS. 2A-2D are diagrams depicting one embodiment of a socket that may be inserted and sealingly fastened within the kayak aperture.
Figure 2B:
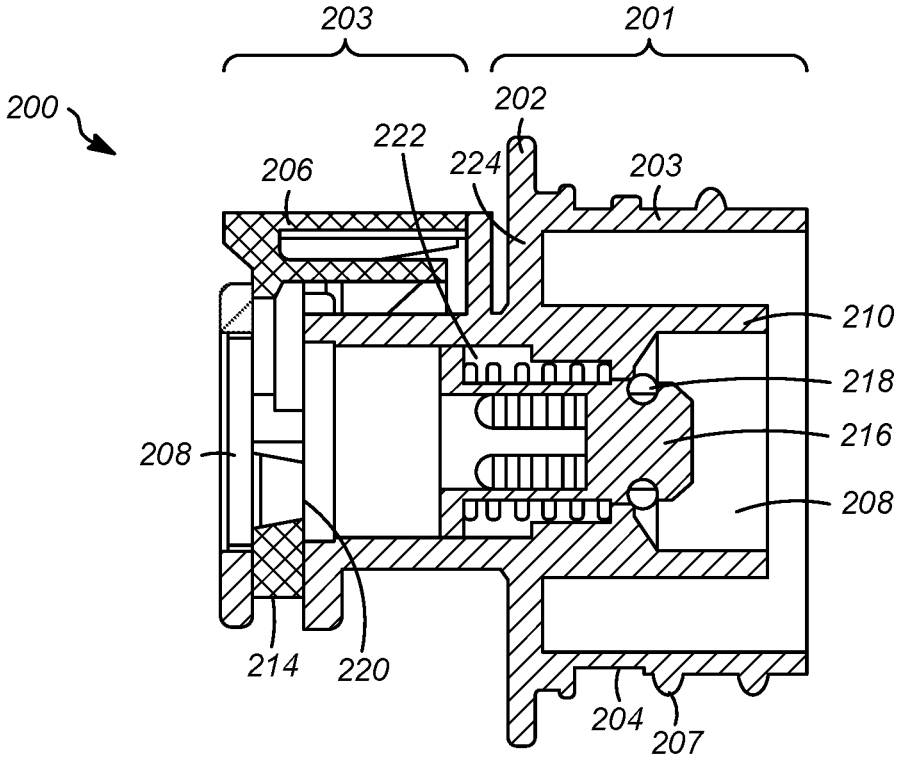
Figure 2C:
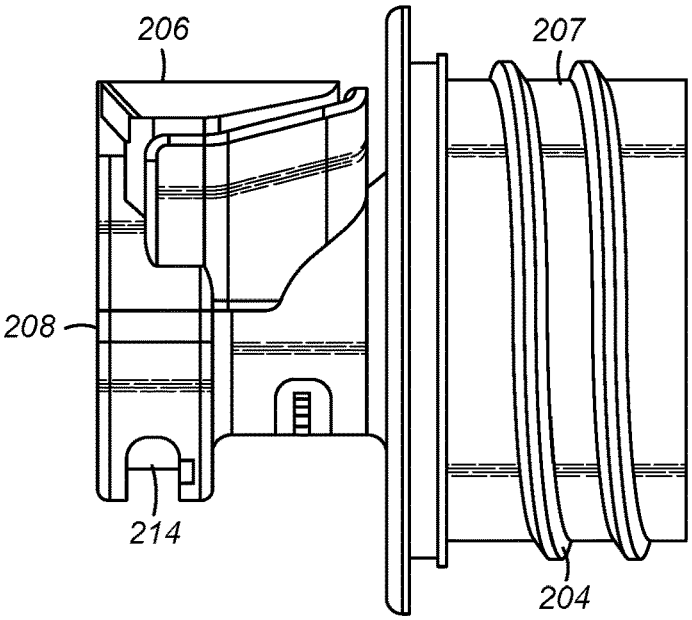
Figure 2D:
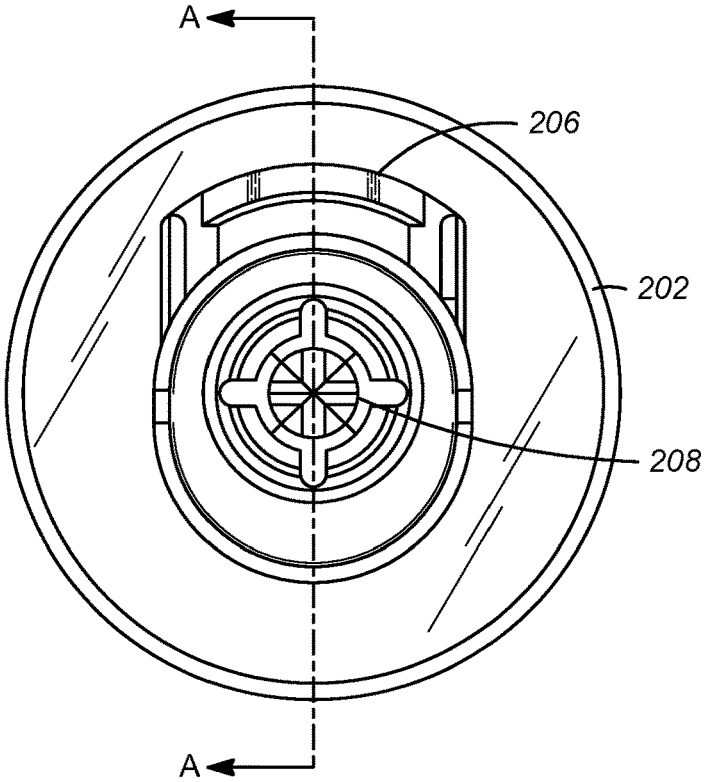

FIG. 1 is a diagram depicting one embodiment of a flexible and foldable water vessel 100 for use in the interchangeable vessel system. The vessel 100 comprises a sealed end 104 and an unsealed end 106 disposed distal from the sealed end 104. The unsealed end 106 comprises a kayak-shaped end piece 108 that is sealingly coupled to the unsealed end 106.

The kayak-shaped end piece 108 further comprises a kayak aperture 110 extending therethrough along a kayak-aperture longitudinal axis 114. The kayak aperture 110 has a circular cross-section and a kayak threaded surface 116 parallel to the kayak aperture longitudinal axis 114 sized and shaped to accept a socket 200 depicted in FIGS. 2A-2D below. The kayak aperture has internal threads 118 that couple with associated threads on the socket 200 to sealingly hold the socket 200 within the kayak aperture 110. The socket permits connection of different components, thus creating a hydration and water storage and dispensing system otherwise referred to as DRINKLINK.

FIGS. 2A-2D are diagrams depicting one embodiment of a socket 200 that may be inserted and sealingly fastened within the kayak aperture 110. The socket 200 forms an important part of the DRINKLINK system, as it permits different elements to be coupled together, as described further below. In this embodiment, the socket 200 comprises a cap portion 201 that is placed within the kayak aperture 110 and a latch portion 251 that is used to accept attachments with a lip portion 202 therebetween. The cap portion 201 comprises a first male portion 203 having a first male portion longitudinal axis 205.

The first male portion 203 includes a male portion threaded 207 surface 204, that, when the first male portion 203 is inserted in the kayak aperture 110 and rotated about axis 205 (collinear with axis 114) to screw the male portion 203 into the kayak aperture 110, engages the threaded surface of the kayak aperture 110 to sealingly hold the socket 200 in place on the vessel.

The socket 200 also comprises a second male portion 210 coupled to the first male portion 203. The second male portion 210 extends longitudinally and coaxially through the first male portion 203, and includes a female aperture portion 208 that extends longitudinally and coaxially through the second male portion 210 and also through the first male portion 203. The first male portion 203 and the second male portion 210 are coupled via socket portion 224, which runs substantially perpendicular to the first male portion longitudinal axis 205, and seals the first male portion 203 to the second male portion 210.

In the illustrated embodiment, the second male portion 210 is disposed completely within the first male portion 203, and coaxially with the first male portion 203. As further described below, this design places the second male portion 210 (as well as third male portion 216, when inserted into female portion 208) within the first male portion 203, and hence, within the kayak aperture 110, thus reducing the distance that socket 200 extends from the kayak aperture 110 when inserted therein. This makes for a more compact assembly of the socket 200 and vessel 100 when assembled, subjects the external portions (including the latch 206, and latch locking member 214 and any attachments) to reduced load moments, making them more durable in the event that the assembly is dropped, and reducing the probability that the valve assembly will experience lower temperatures and be subject to icing. In one embodiment, the second male portion 203 is inserted substantially within the first male portion 201, such that the valve assembly is sufficiently insulated to prevent formation of ice under normal use.

The socket 200 latch portion 251 comprises a latch 206 that is slidably coupled to the second male portion 210. When the latch 206 is slidably moved, the female aperture 208 is partially occluded by a portion of the latch, the latch locking member 214.

The vessel system also includes a plurality of different attachments that are insertable into the female aperture portion 208 of the second male portion 210. These attachments include a third male portion 216 that has an outer surface substantially conforming to the inner surface of the female aperture portion 208. The third male portion 216 is inserted into the female aperture portion 208, and held in place by engagement of the latch locking member 214 with a latching surface 220 of the third male portion 216. O-ring 218 provides waterproof mating of the third male portion 216 and the female aperture portion 208. Upon disengagement of the latch 214 with the latching surface 220, spring 222 urges the third male portion out of the female aperture portion 208

Figure 3A:
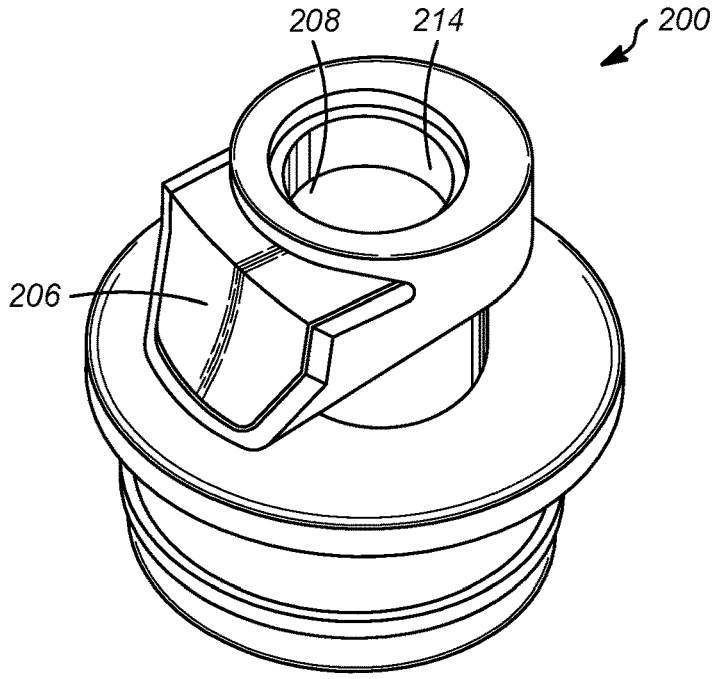
FIGS. 3A and 3B are diagrams depicting the socket and an attachment.
Figure 3B:
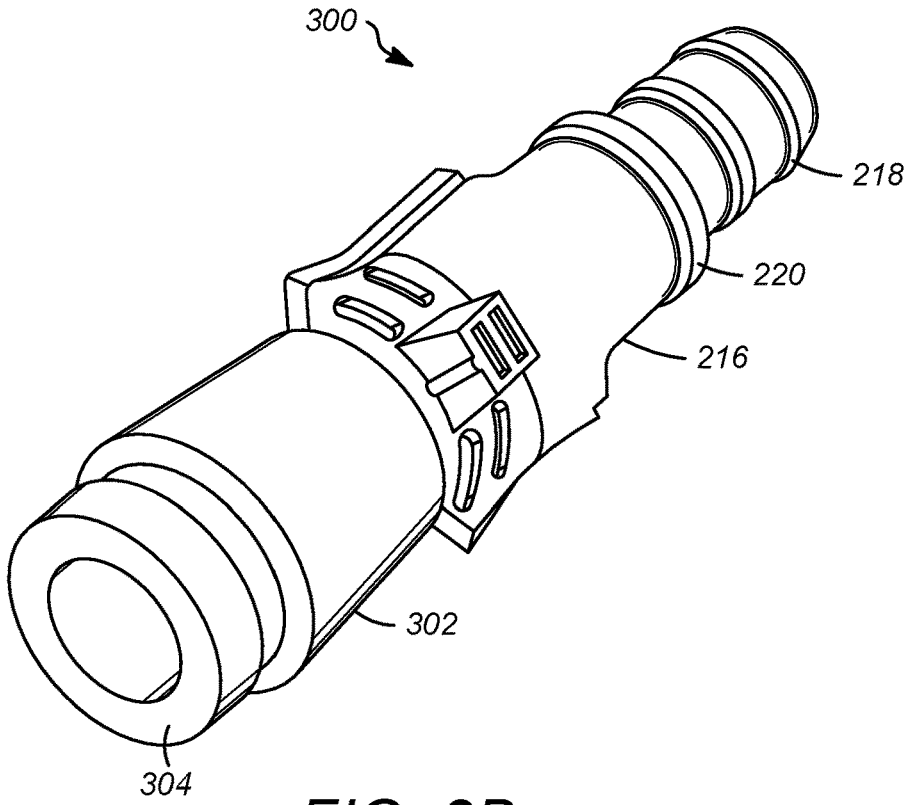

FIGS. 3A and 3B are diagrams depicting the socket 200 and one embodiment of an attachment 300, respectively. The attachment 300 includes the third male portion 216 and a tube portion 302 that may be slid over friction surfaces on third male portion 216 for a waterproof seal and fluid connectivity.

As illustrated, the tube portion 302 may comprise a short tube with a bite valve 304 attachment. So configured, when the socket 200 is screwed into the kayak aperture 110, the female aperture portion 208 is presented. The third male portion 216 of a consumption attachment 300 may then be inserted into the female aperture portion 208.

The attachment 300 may be of different embodiments. In one embodiment, the attachment comprises a short (0.5-2 inch) tube 302 or straw and a bite valve 304 on the end of the tube 302 distal from the third male member 216. This configures the vessel system for use as a water bottle.

Figure 4:
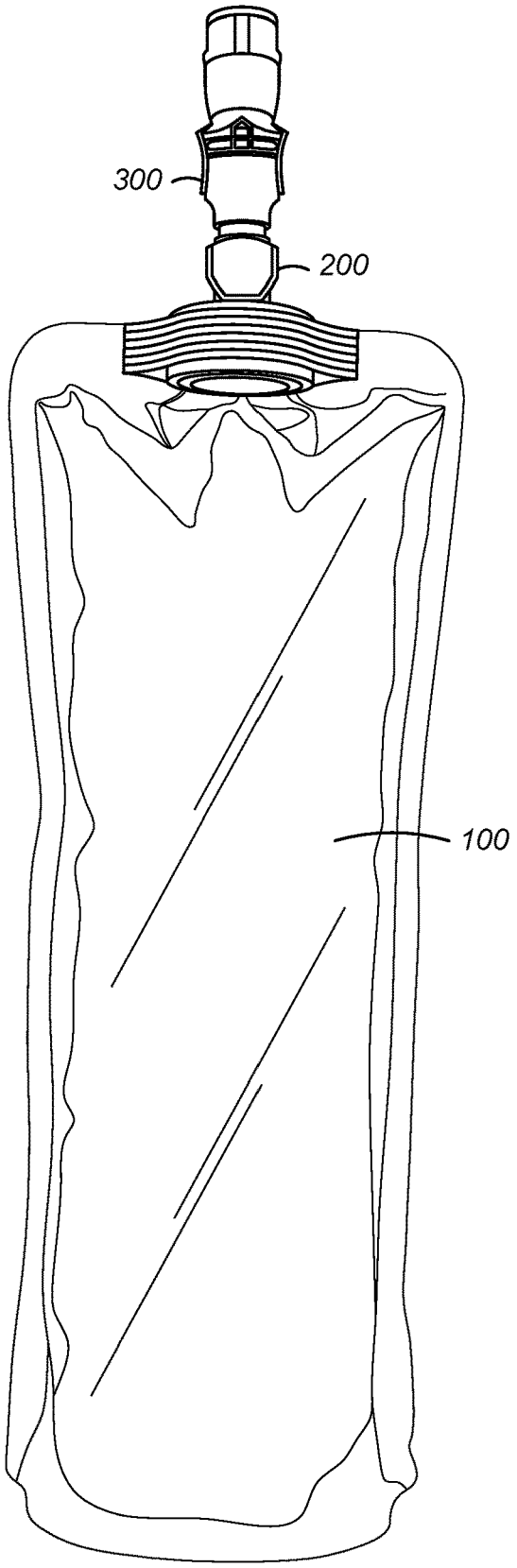
FIG. 4 is a diagram depicting another embodiment of an attachment installed on a vessel via the socket.

FIG. 4 is a diagram of one embodiment of a DRINKLINK system 500 in a water bottle configuration. The DRINKLINK system includes a vessel 100, socket 200 inserted into the kayak and an attachment 300, having a third male member 216 inserted into the female aperture portion 208. In the illustrated embodiment, the attachment 300 comprises a simple bite valve, such as the bite valve 304 shown in FIG. 3. When configured as illustrated in FIG. 4, the DRINKLINK system 500 is configured for use as a water bottle.

Figure 5:
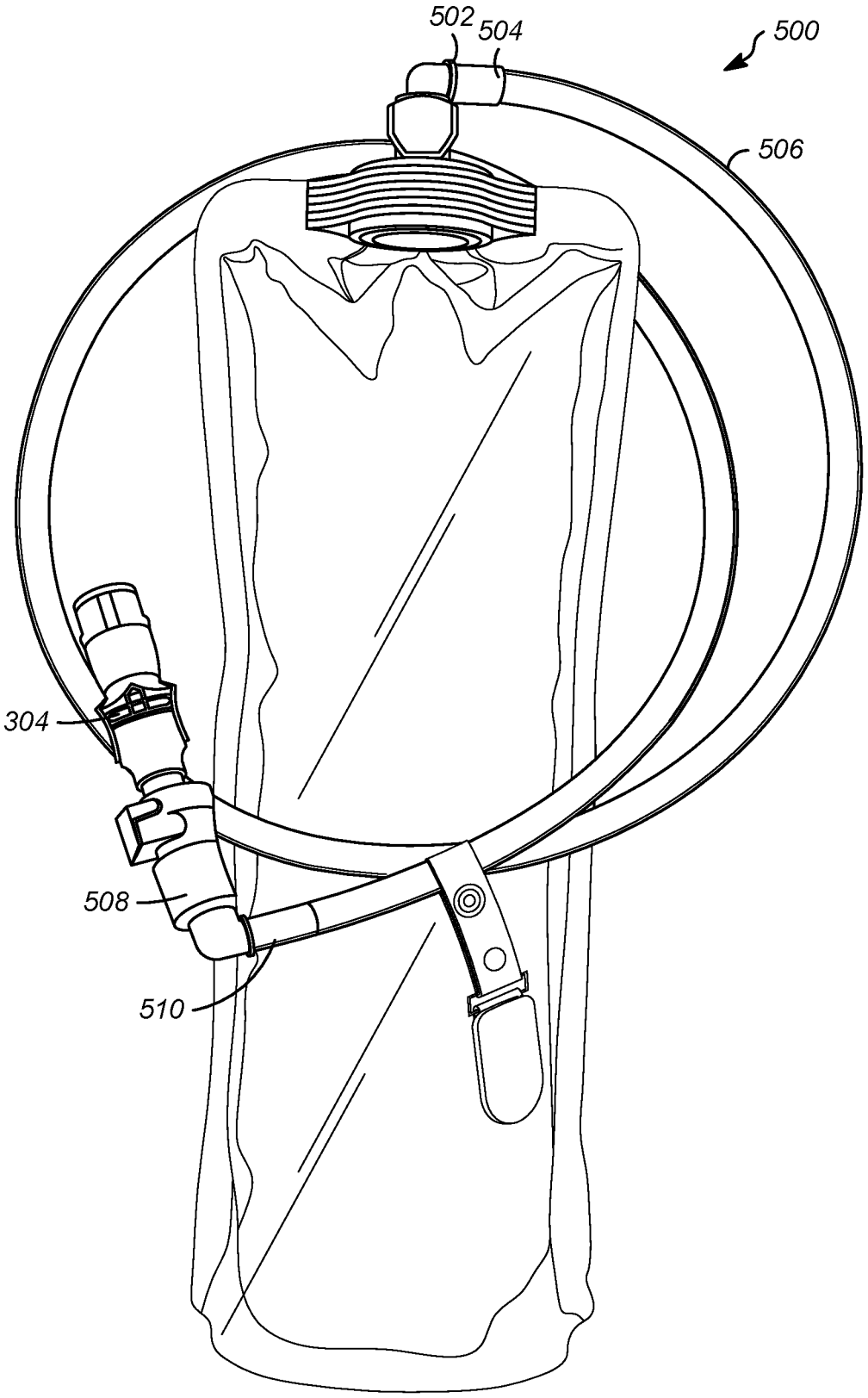
FIGS. 5-20 are diagrams depicting various embodiments of the interchangeable vessel system.

FIG. 5 is a diagram of another embodiment of the DRINKLINK system 500 configured to position the bite valve 304 further remotely from the bladder. In the illustrated embodiment, the socket 200 is inserted into and sealingly affixed to the aperture of the kayak, and a male member portion analogous to the third male portion 216 of an attachment 502 is inserted into the female aperture portion 208 of the socket 200. In addition to the male member portion, attachment 502 also comprises a ribbed male portion 504 that can be sealingly inserted into a tube 506, thus placing the tube 506 into fluid communication with the vessel 100. In the illustrated embodiment, the attachment 502 is a right angle attachment, but other configurations can also be included in the DRINKLINK system 500.

The tube 506 can be of a variety of lengths (e.g. 10-36 inches). At the distal end of the tube 506, another embodiment of the socket 508 may be used. This socket 508 uses a ribbed portion 510 that is sealingly inserted into the tube 506 on one end, and on the other end, includes a structure analogous to the socket latch portion 251. This allows attachments and accessories (such as bit valve 304) to be sealingly attached to the tube 506 via the socket 508. This allows the flexible vessel 100 to be inserted into a pocket of a backpack, while also allowing the user to draw liquid through the tube and bite valve 304 external to the pocket of the backpack for use in a personal hydration system.

Figure 6:
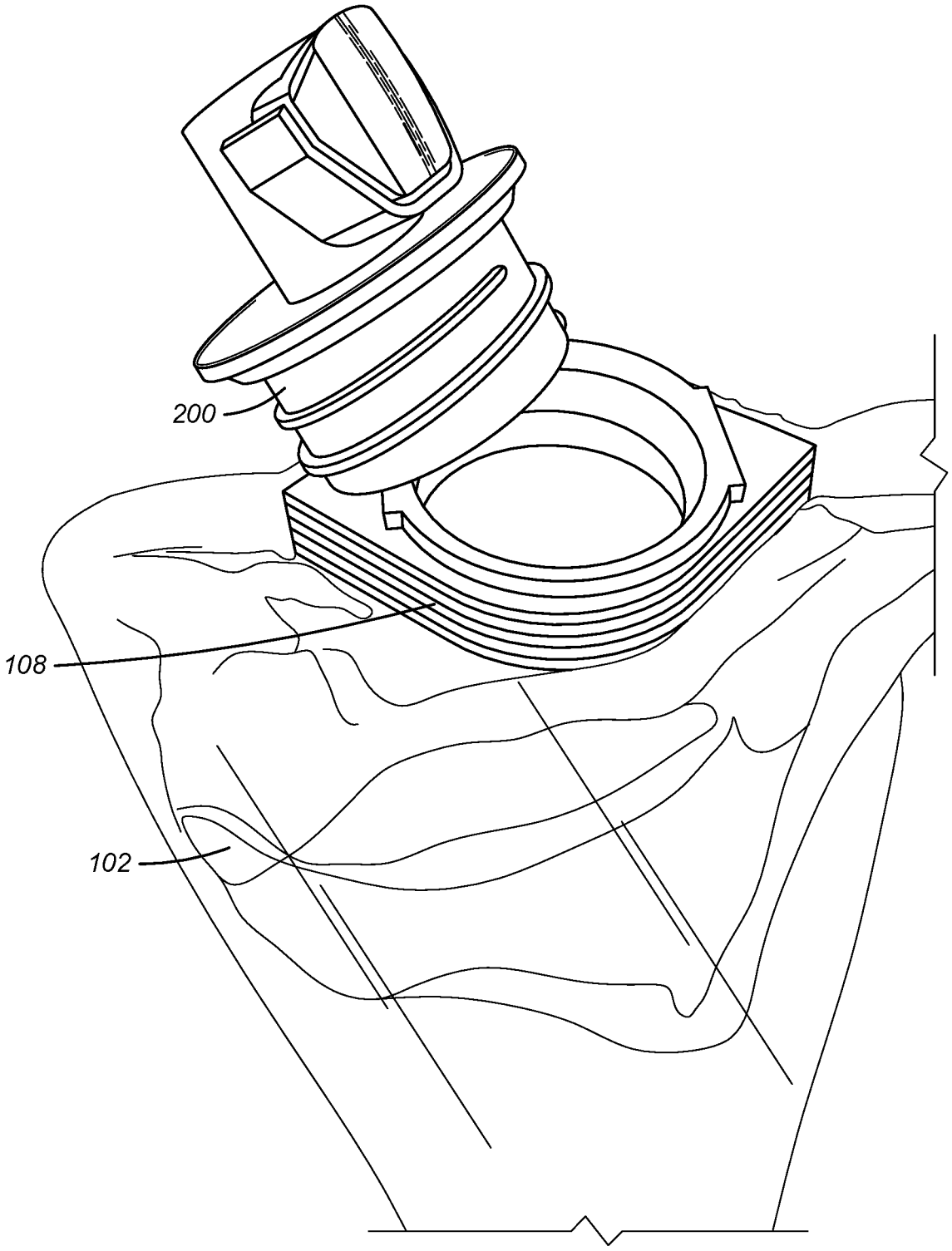

FIG. 6 is a diagram of the vessel 100 and end piece 108, as well as the socket 200 having threads matching the threaded structure of the end piece 108. The socket 200 is shown being inserted into the end piece 108.

Figure 7:
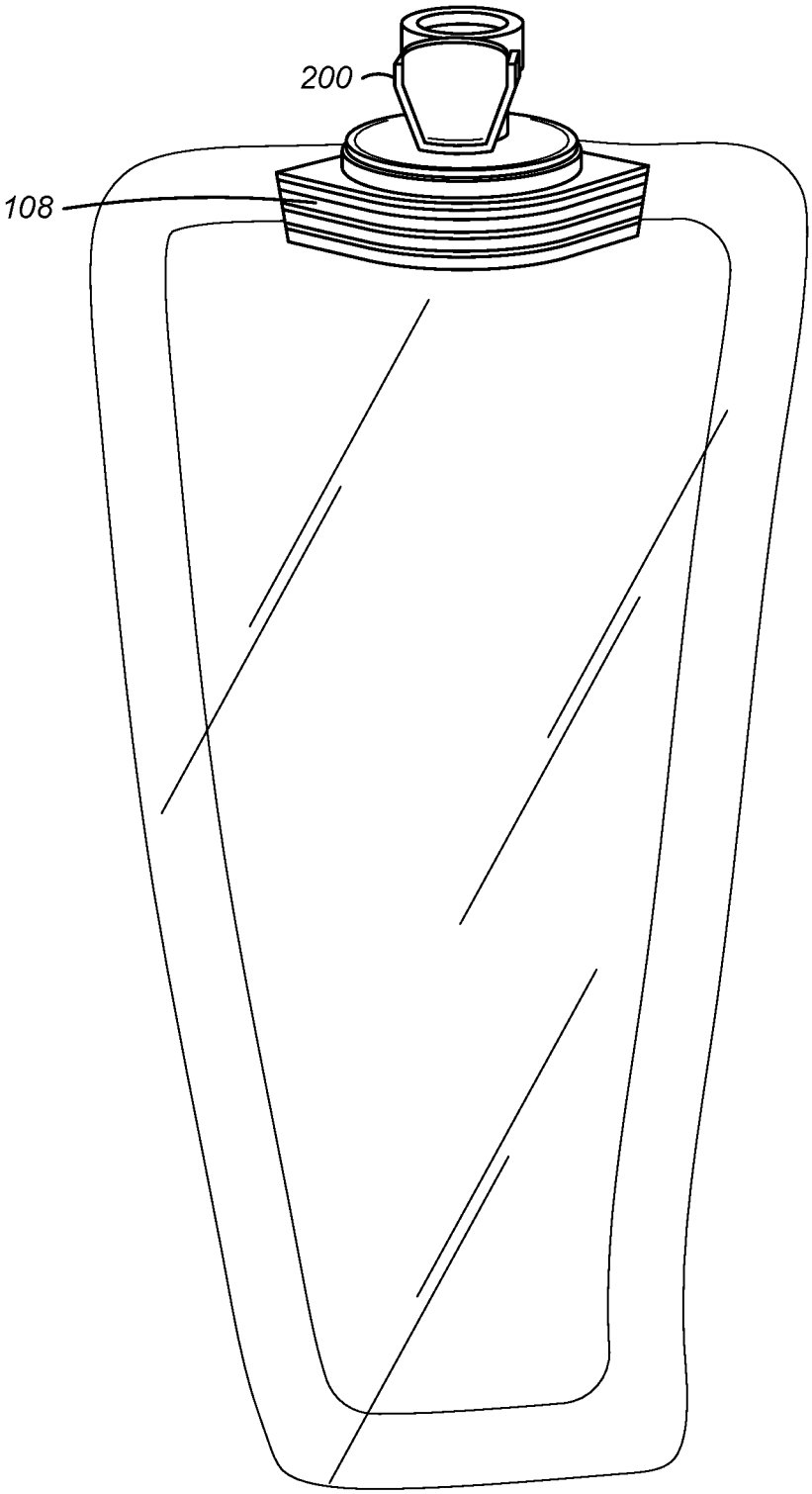

FIG. 7 is a diagram of the vessel 100 after the socket 200 is affixed to the end piece 108 by screwing the socket threads into the end piece 108.

The DRINKLINK interchangeable vessel system also includes water vessels that are not used for personal hydration. For example, the DRINKLINK interchangeable vessel system can include a larger size vessel (e.g. one or more gallons in size) that can be used to dispense water (or other consumable liquids) using a spigot or a shower head attachment. The larger size vessels may be used to provide water (or other consumable and/or non-consumable liquids) from such vessel to a variety of accessories via one or more sockets 200 and similar couplers.

Figure 8:
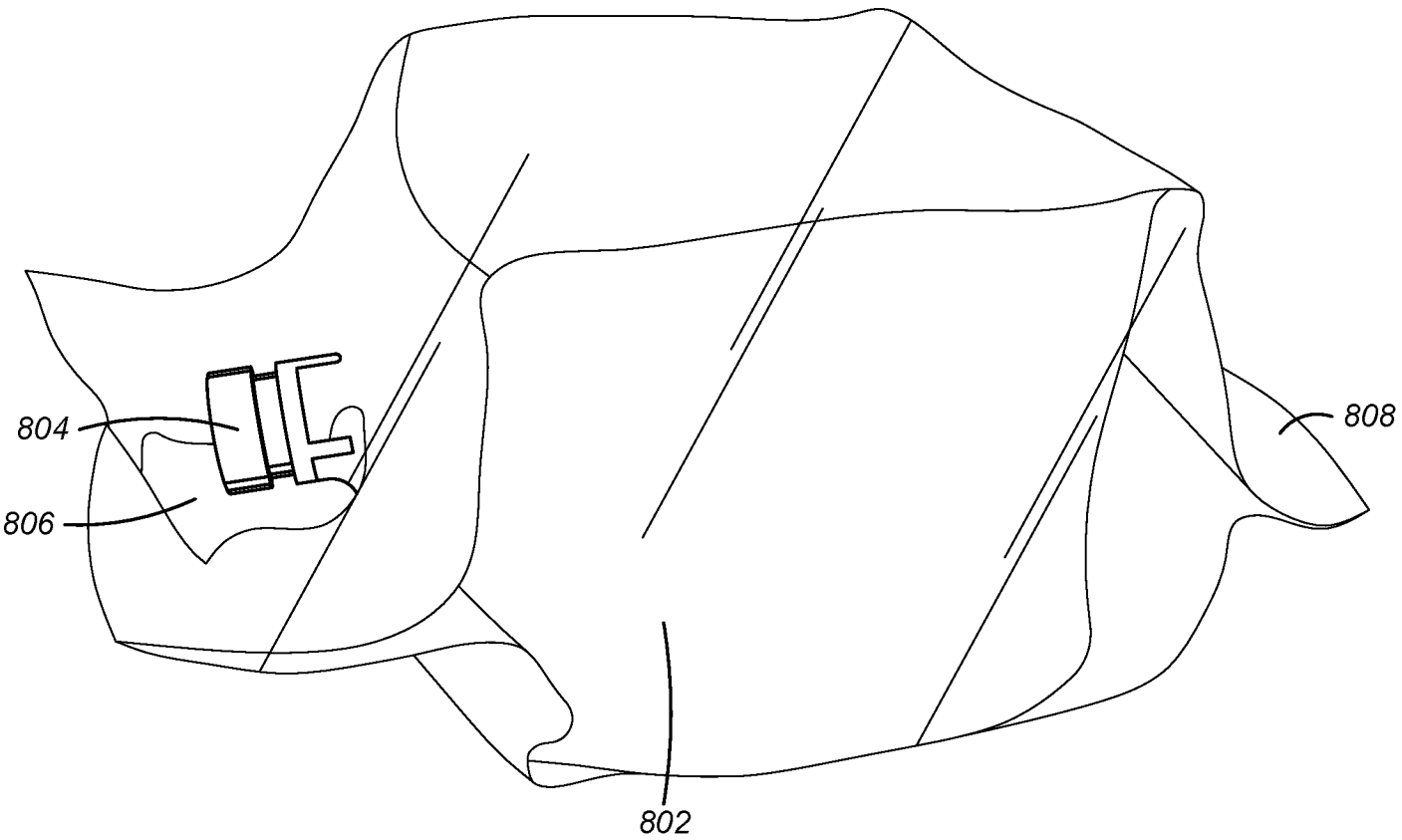

FIG. 8 is a diagram of another embodiment of a larger capacity vessel 802. In this embodiment, the vessel 802 is not typically used for personal hydration (e.g. it is not carried by the user), but is instead, holds a greater volume of water or other consumable liquids (for example, greater than one gallon). In the illustrated embodiment, the vessel 802 is cube-like in shape, and thus includes a flat side, allowing the vessel to be placed on it's side on a surface. This embodiment of the vessel 802 also includes a handle 806 on at least one end of the vessel, thus allowing the vessel 802 to be easily carried about (in spite of a weight of about 20 pounds when full), and allowing the vessel 802 to be hung from a supporting structure. The vessel 802 may also include a second handle on the opposing side of the vessel 802. In the illustrated embodiment, the vessel 802 is sealingly closed with a cap placed on a threaded structure 804.

Depending on the structure of vessel 804, the socket 200 may be screwed into a kayak-shaped end piece 108 (if the associated portion of the vessel is folded analogously to vessel 100), however, other embodiments are possible where the socket 200 is simply screwed into or otherwise attached to an aperture of the vessel 804 having matching physical features. Of course, while socket 200 and other structures are illustrated as screwing into complimentary structures on other elements, other embodiments may be used in which the socket 200 sealingly snaps into the appropriate structure.

Figure 9:
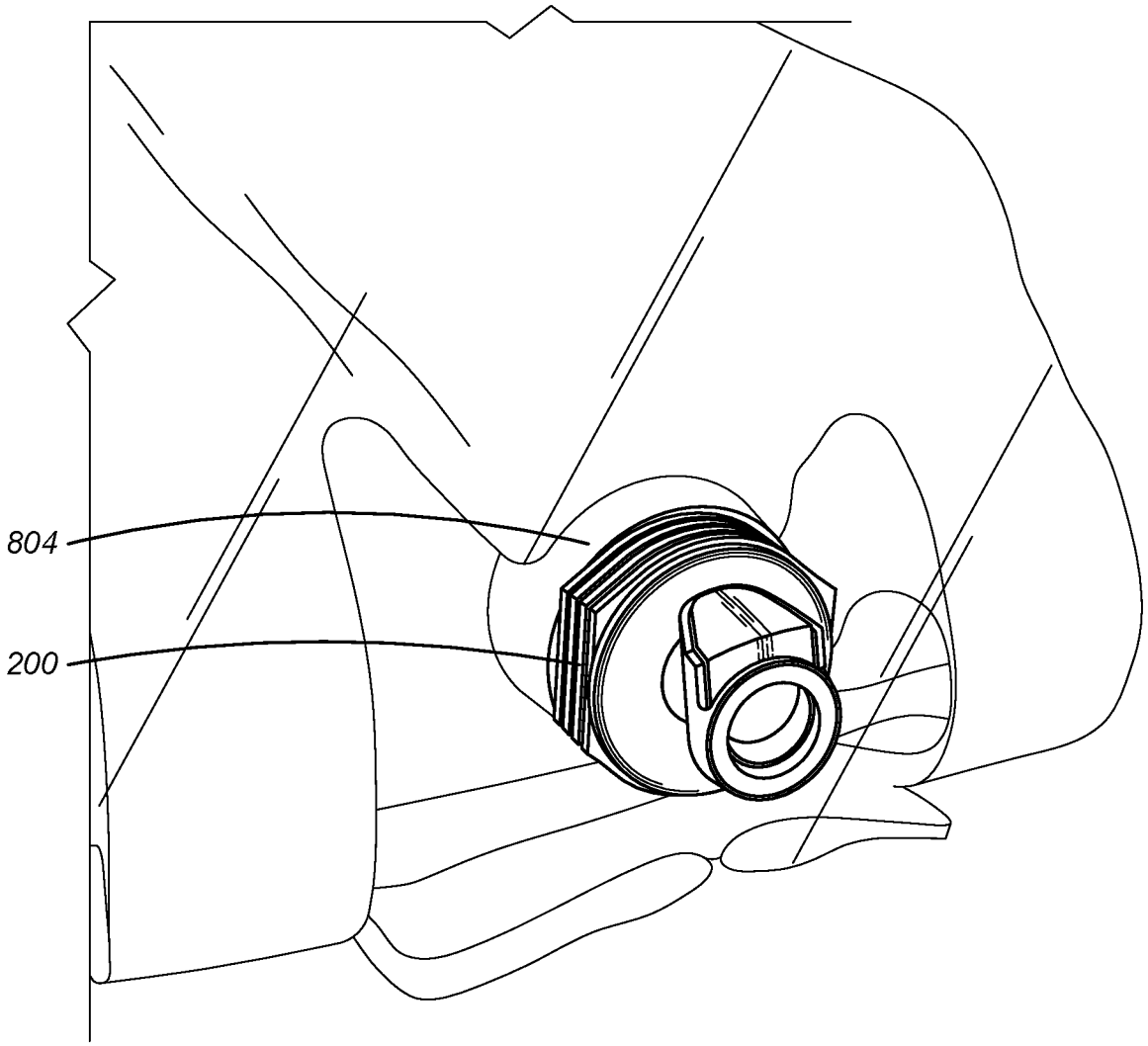

FIG. 9 is a diagram of the vessel 802 with the socket 200 threaded into the threaded structure 804.

Figure 10:
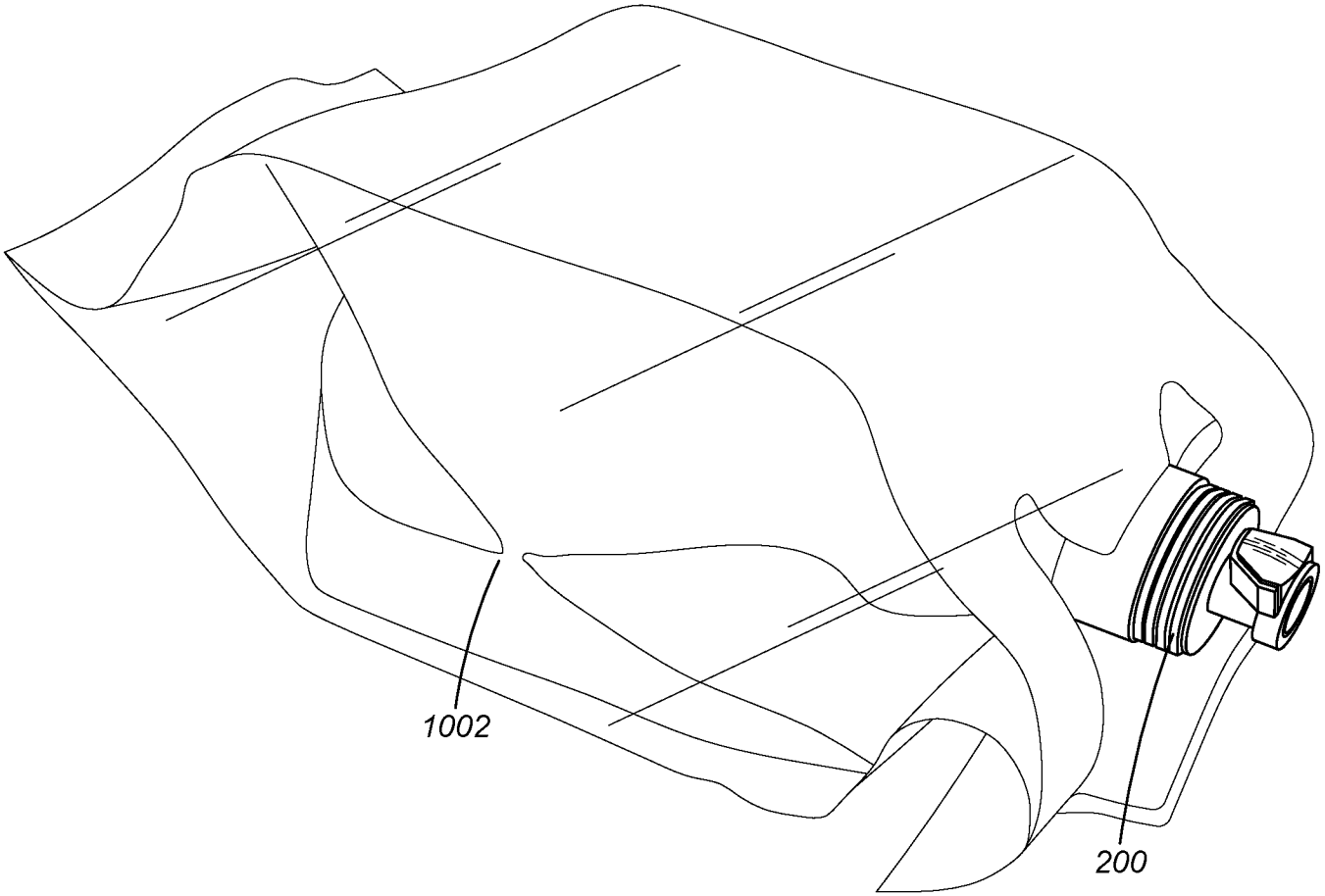

FIG. 10 is a diagram of the vessel 802, showing the cube shape and folds 1002 that allow the vessel 802 to be folded flat.

Figure 11:
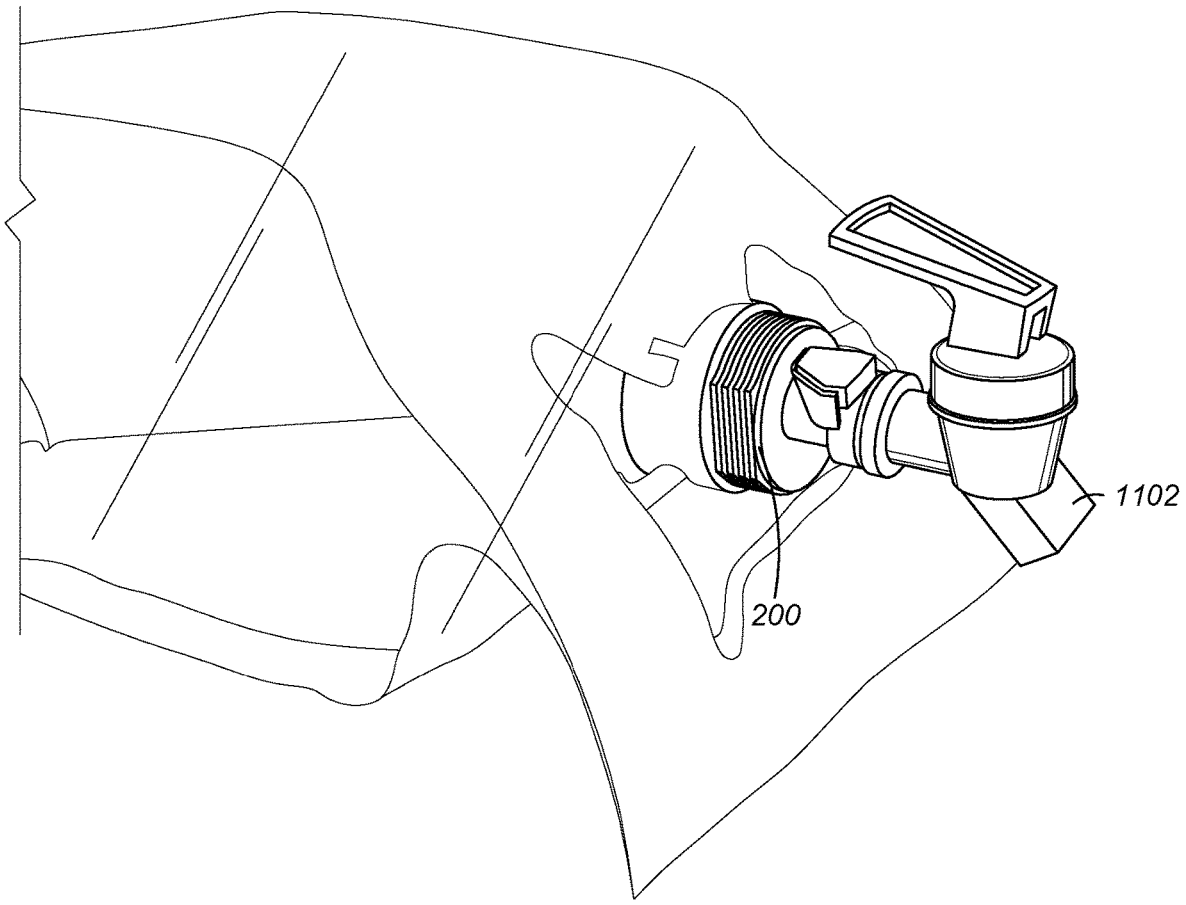

FIG. 11 is a diagram of a spigot 1102 that can be inserted into the socket 200 female aperture portion 208. Although not illustrated, the spigot 1102 has a male portion 216 similar to the male portion 216 of FIG. 3, that is inserted into the female aperture portion 208 of the socket 200. The spigot 1102 allows the vessel 802 to easily dispense consumable liquids into cups and similar vessels. Thus, the vessel 802 and spigot 1102 may be placed on a table or other flat surface, and be used to dispense consumable liquids.

Figure 12:
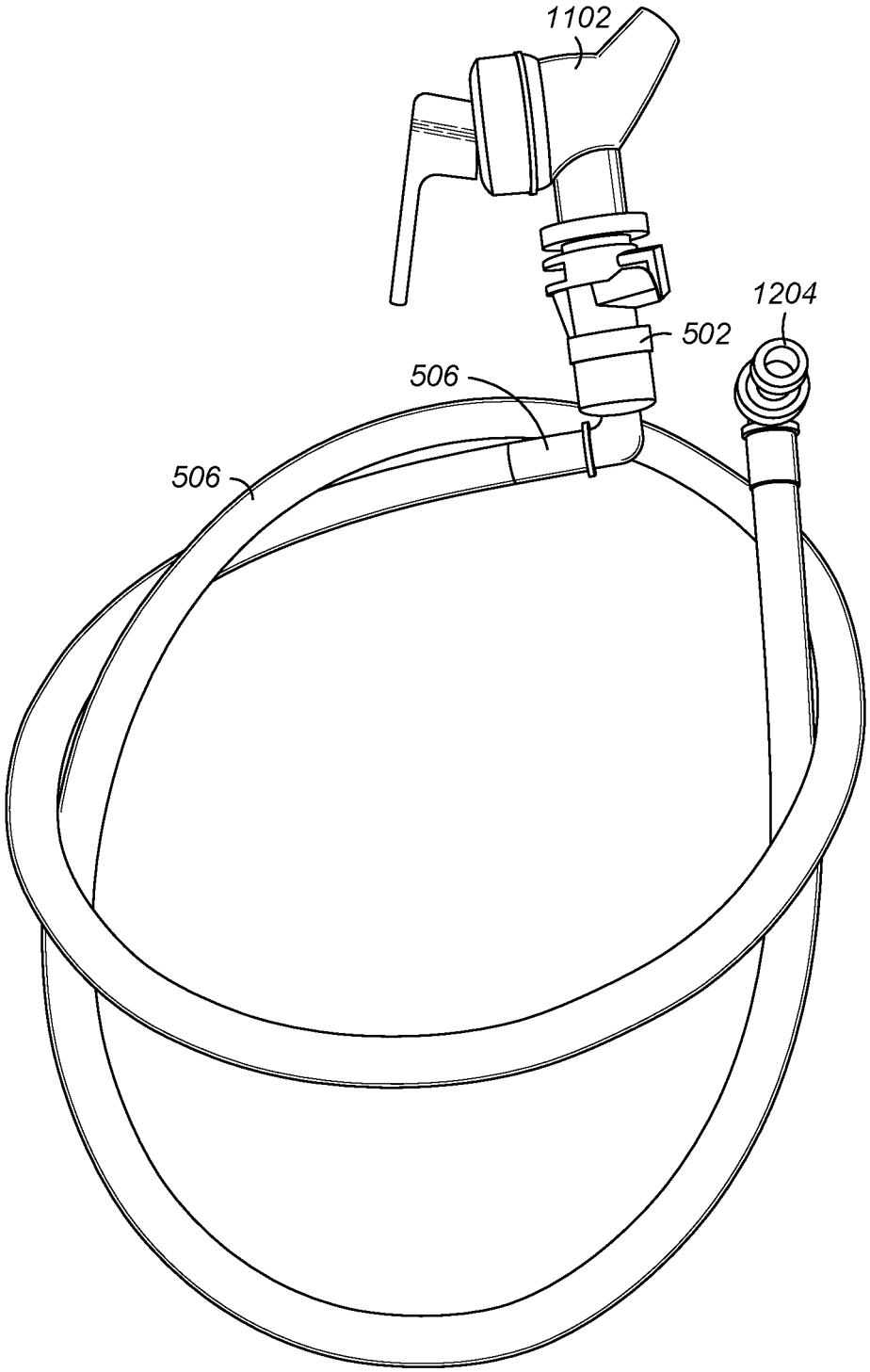

FIG. 12 is a diagram of the spigot 1102 attached to a tube 506 via a socket 502 having a right angle bend. As described above, this embodiment of the socket 502 does not comprise a threaded male portion 203, but rather, a ribbed male portion 504 that is inserted into the tube 506 to place the tube 506 and the socket 502 in sealed fluid communication. Spigot 1102 is inserted into the other end of the socket 502, which has a structure analogous to the latch portion 251 of socket 200. Attachment/coupler 1204 comprises a right angle joint having a similar ribbed male portion for insertion into the tube 506 and a male portion similar to male portion 216 that is inserted into the female aperture portion of a socket 200.

Figure 13A:
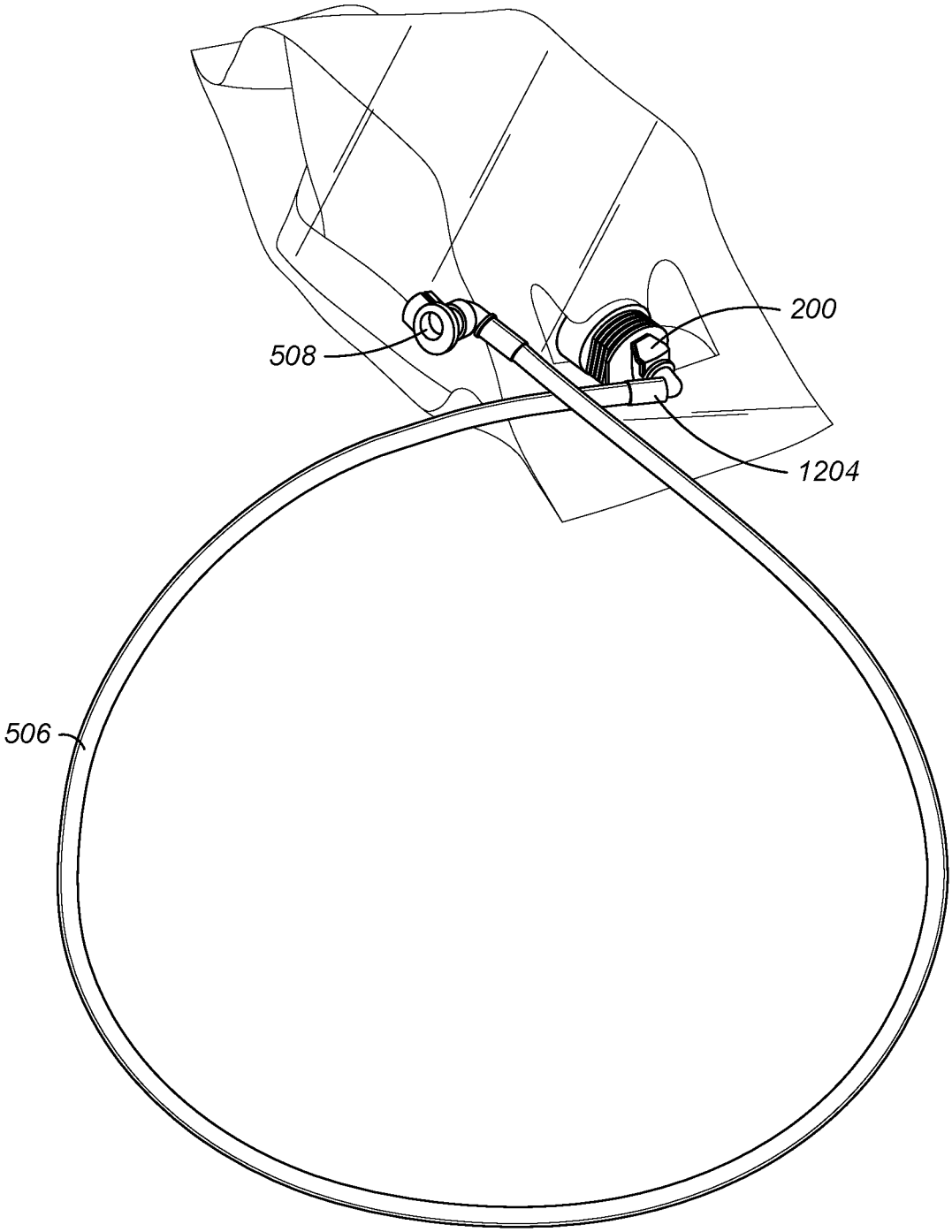

FIG. 13A is a diagram showing the socket 200 installed in the vessel 802, and the coupler 1204 installed in the socket 200. The coupler 1204 has a ribbed portion inserted into the interior of the tube 1206. Socket 508 having a ribbed male portion disposed at a right angle is inserted other end of the tube 1206. In this configuration, accessories may be inserted into the other end of socket 508, which has a structure analogous to the socket 200, as further illustrated and described below.

Figure 13B:
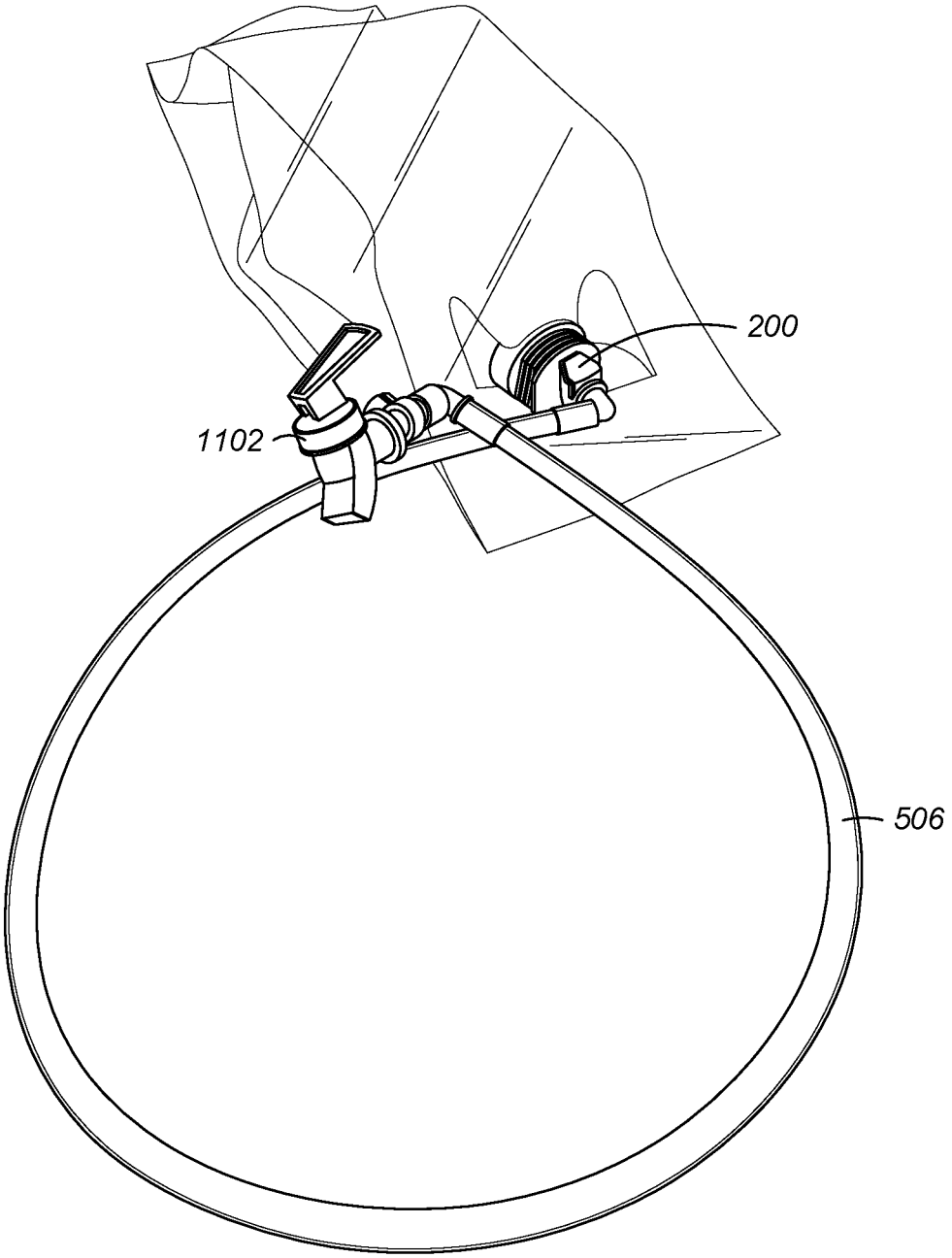

FIG. 13B is a diagram showing the spigot 1102 inserted into the female aperture portion 208 of attachment 508, thus configuring the system into a large vessel 802 providing consumable liquids to the spigot 1102 via an extended tube 506.

Figure 14:
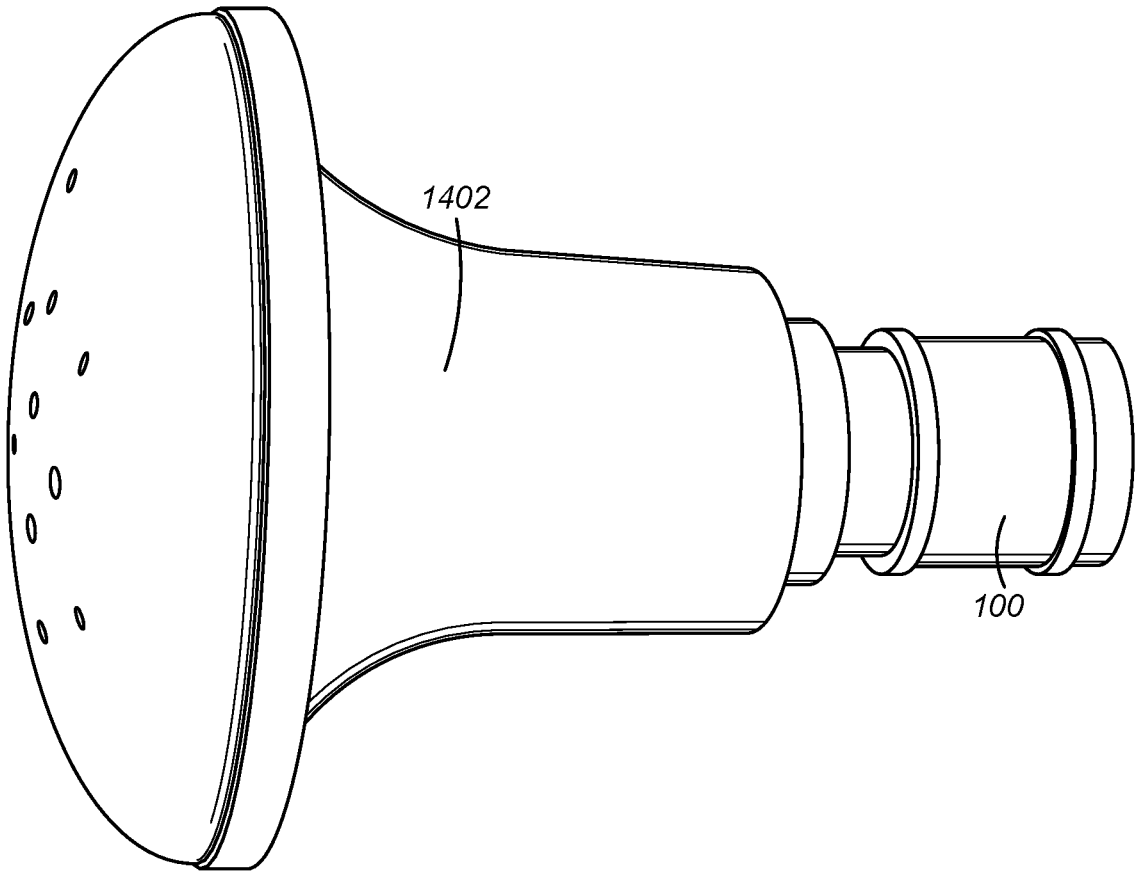

FIG. 14 is a diagram showing an dispersing head 1402, which can be used as a shower head or similar application. The dispersing head 1402 includes a male portion 216 for insertion into the female aperture portion 208 of the socket 200 or socket 508 (or similar structure).

Figure 15:
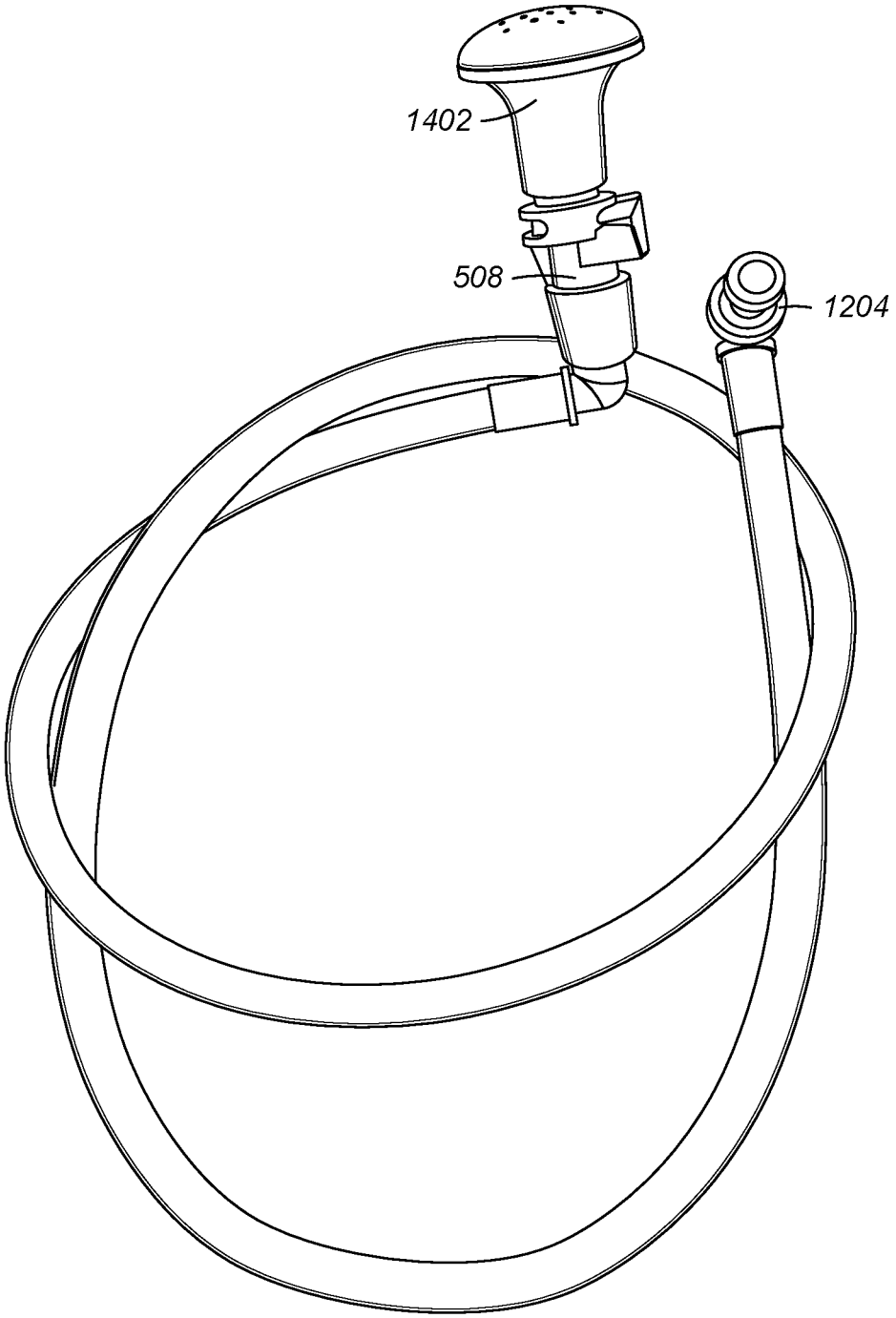

FIG. 15 is a diagram showing the dispersing head 1402 male portion 216 inserted into the female aperture portion 208 of the socket 508 having the right angle ribbed portion and the socket portion.

Figure 16:
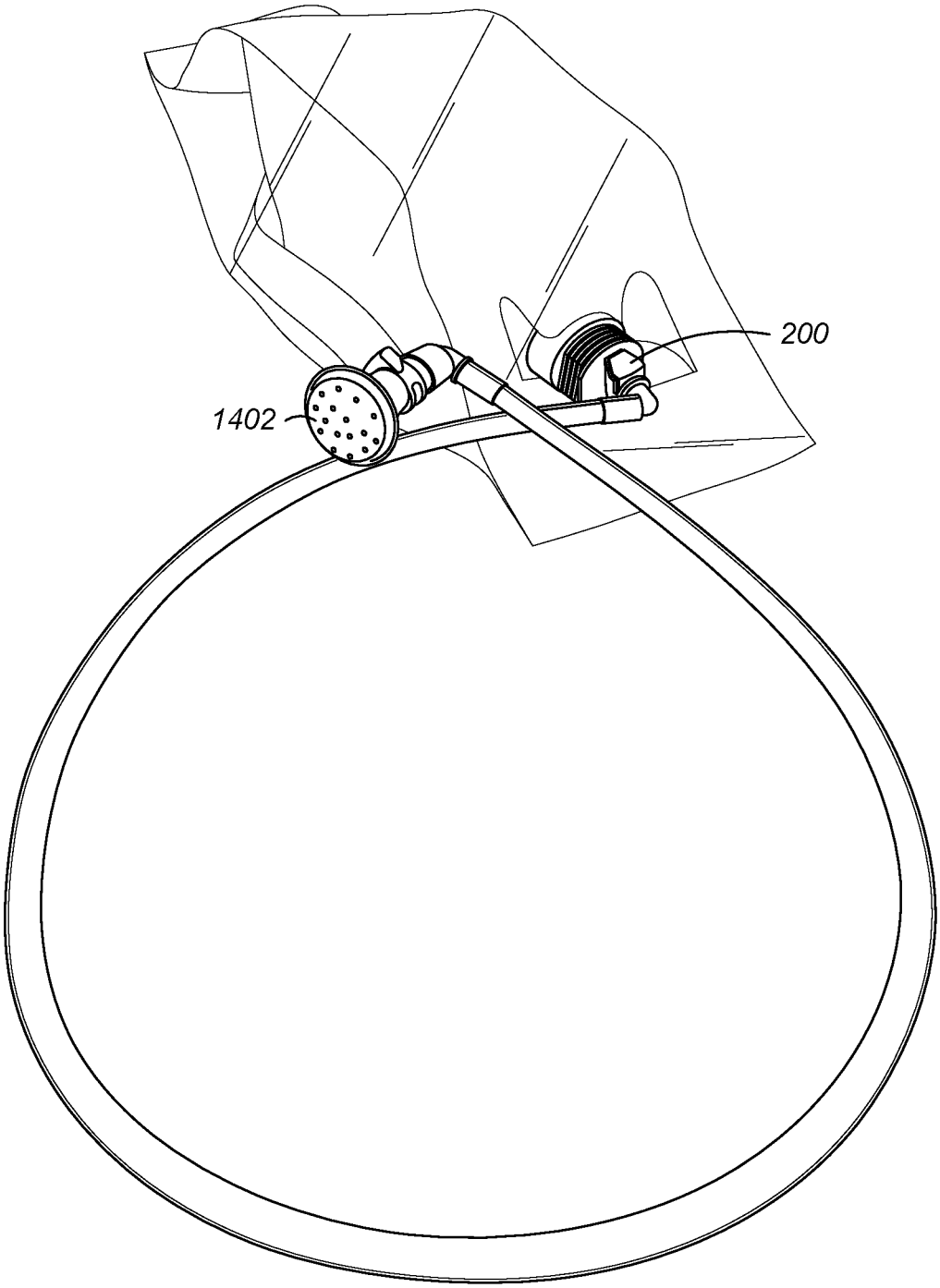

FIG. 16 is a diagram showing the dispersing head 1402 with the male portion 216 inserted into the female aperture portion 208 of the socket 508. In this configuration, the resulting system may be used as a shower. Although the vessel 800 is illustrated as orange, the vessel for such a configuration may be black or a similar color to absorb solar radiation and warm the liquid inside the vessel 802.

Figure 17:
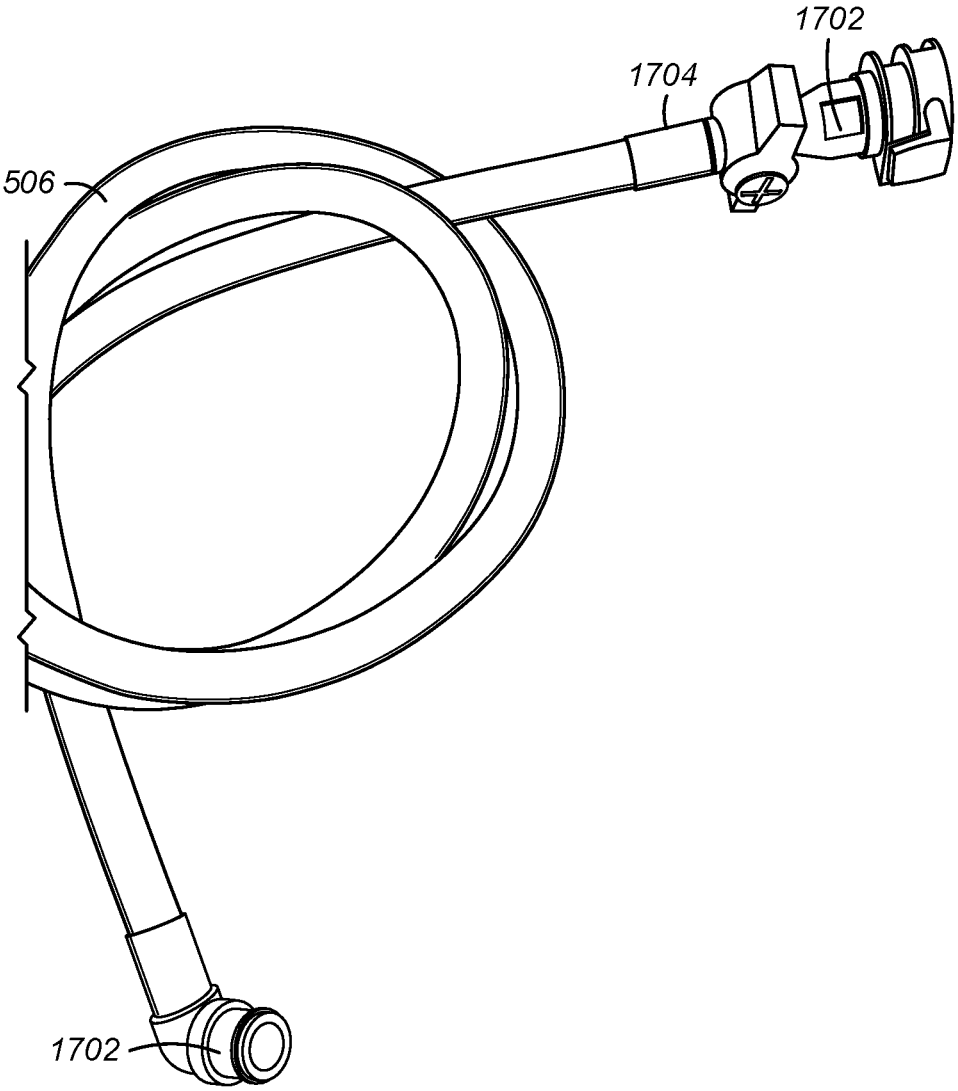

FIG. 17 is a diagram showing another embodiment of a socket 1702. In this embodiment, the socket 1702 as a structure analogous to that of socket 502, but no right angle bend. The socket 1702 has a ribbed portion 1704 that is inserted into one end of the tube 1206, and the ribbed portion of a right angle coupler 1706 is inserted into the other end of the tube. The right angle coupler 1706 includes a male portion 216 that can be inserted into the female aperture portion 208 of sockets 200 or 1202.

Figure 18:
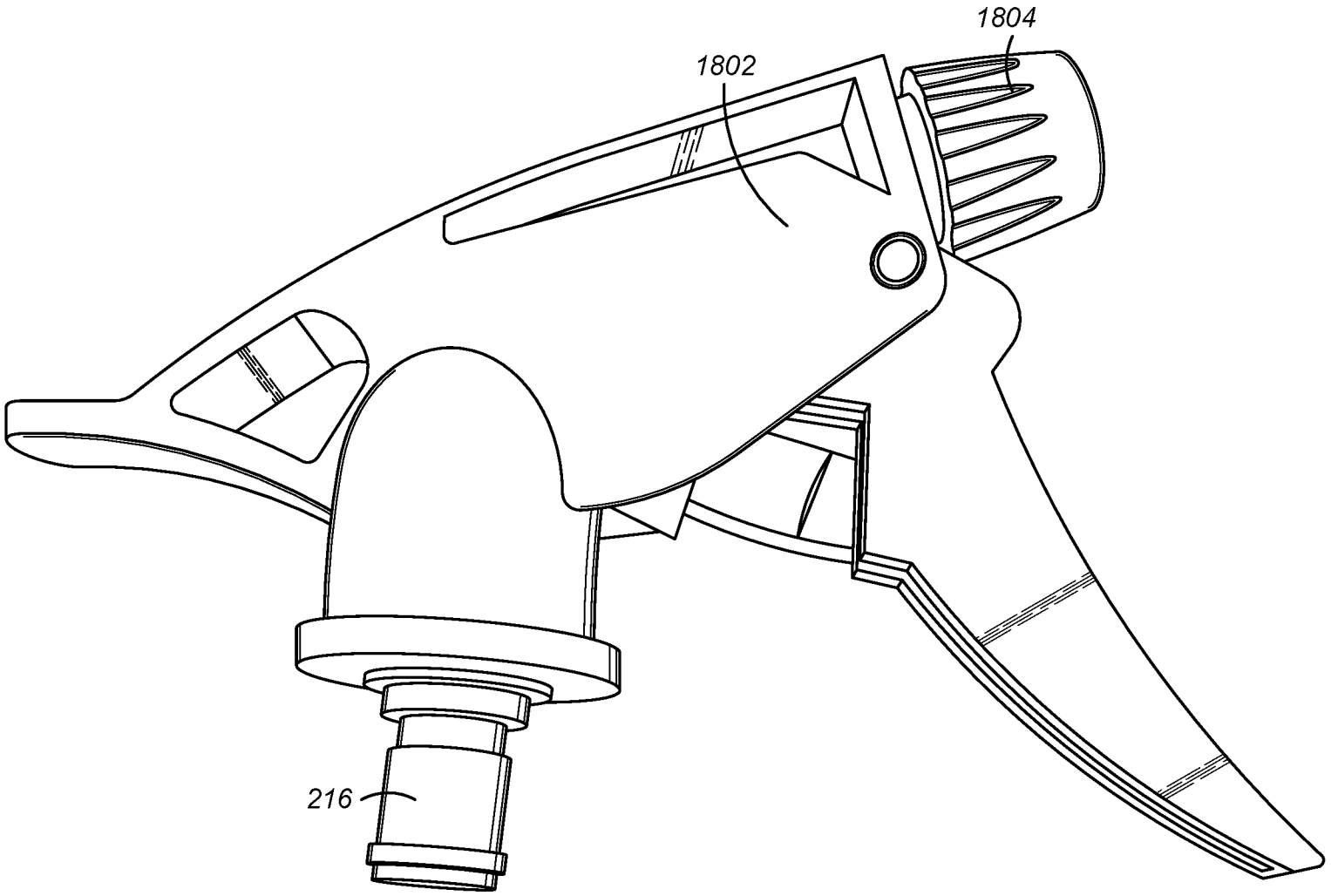

FIG. 18 is a diagram of a spray head 1802 having a male portion 216 that can be inserted into the female aperture portion 208 of sockets 200 or 1202.

Figure 19:
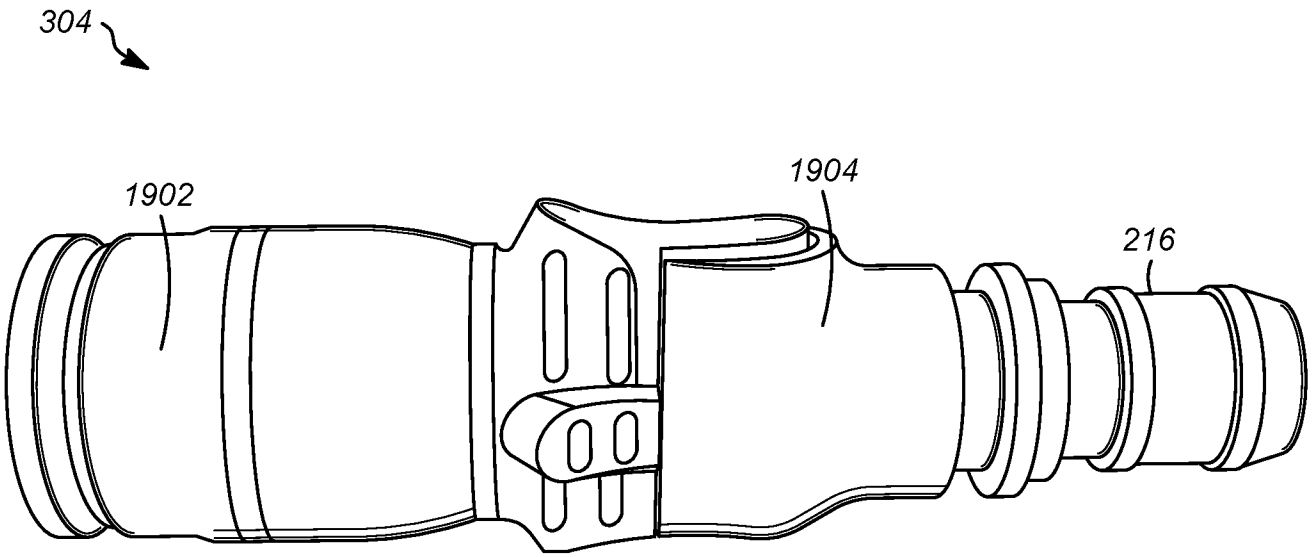

FIG. 19 is a diagram of the bite valve attachment 304. The bite valve attachment has a male portion 216 that can be inserted into the female aperture portion 208 of sockets 200 or 1202. This embodiment of the bite valve 1900 includes a waterproof joint 1904, allowing the bite valve portion 1902 to be oriented to be collinear with the male portion 216 or angled from being collinear by 90 degrees or more.

Figure 20:
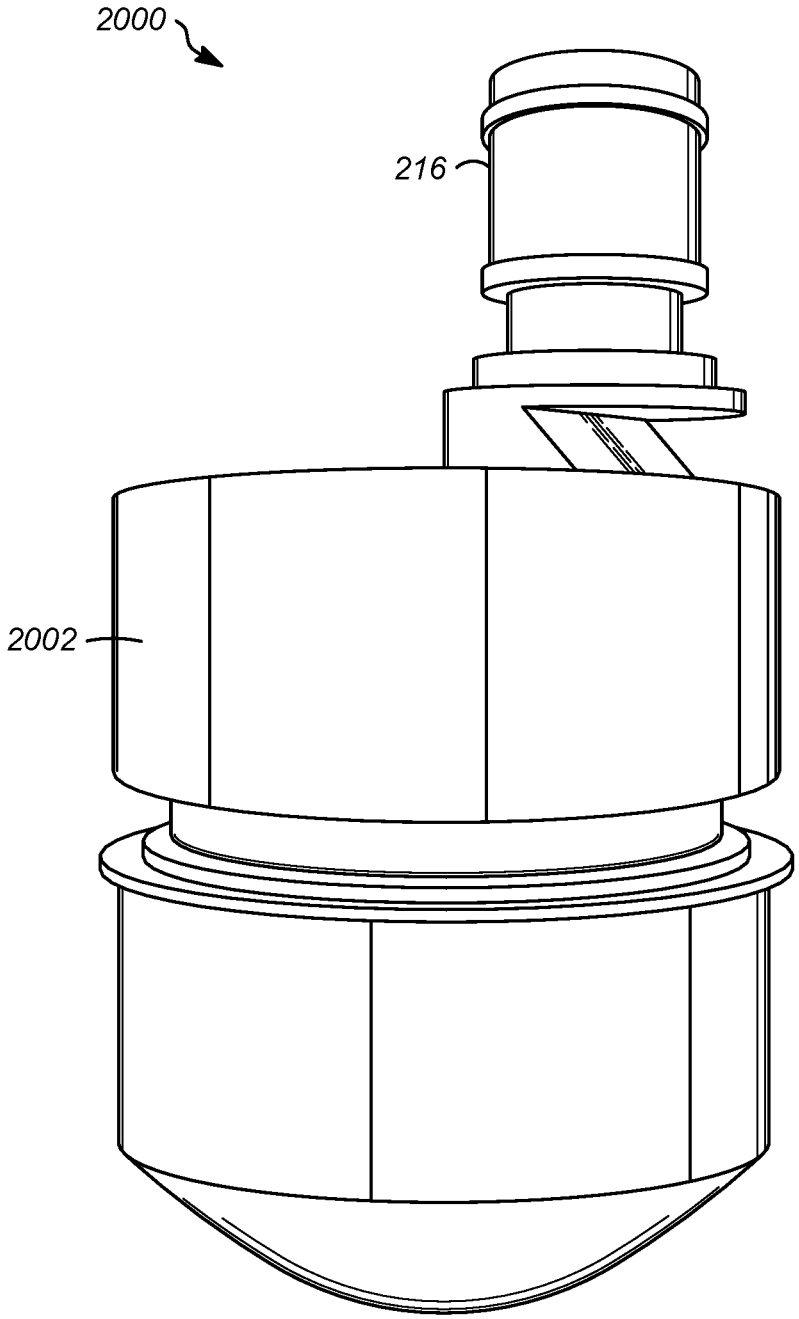

FIG. 20 is a diagram of a pet hydration attachment 2000 having a male portion 216 that can be inserted into the female aperture portion 208 of sockets 200 or 1202. The pet hydration attachment includes a module 2002 that accepts and presents fluid to the pet for drinking purposes.

CONCLUSION

This concludes the description of the preferred embodiments of the present disclosure. The foregoing description of the preferred embodiment has been presented for the purposes of illustration and description. It is not intended to be exhaustive or to limit the disclosure to the precise form disclosed. Many modifications and variations are possible in light of the above teaching. The claim appended hereto describes features of the subject of this application in detailed terms, including optional features that might be useful in some embodiments, but not required for all embodiments, and is presented for purposes of describing claim features that might be included in various combinations thereof.

What is claimed is:

1. A modular interchangeable vessel system, comprising:

a flexible and flat-foldable waterproof vessel having a sealed end and an unsealed end disposed distal from the sealed end, the unsealed end having an endpiece sealingly coupled thereto, the endpiece having an endpiece aperture extending therethrough along an endpiece aperture longitudinal axis, the endpiece aperture having a circular cross section and an endpiece threaded surface parallel to the endpiece aperture longitudinal axis;

a socket, comprising:

a body, having;

a first male portion having a first male portion longitudinal axis, the first male portion coaxially insertable in the endpiece aperture, the first male portion having a male portion threaded surface for sealingly engaging the endpiece threaded surface;

a second male portion, sealingly coupled to the first male portion, the second male portion extending longitudinally and coaxially through and within the first male portion, the second male portion having a female aperture portion extending longitudinally and coaxially through the second male portion and wherein the second male portion is disposed within the endpiece when the socket is sealingly engaged with the endpiece threaded surface.

2. The system of claim 1, wherein the second male portion extends completely within the first male portion.

3. The system of claim 2, further comprising:

a latch, slidably coupled to the second male portion, the latch slidably movable to occultationally reduce a cross section of a portion of the female aperture portion.

4. The system of claim 3, further comprising:

a consumption attachment, comprising:

a third male portion, having:

an outer surface substantially conforming to and for insertion within an inner surface of the female aperture portion;

a sealing ring, sealingly coupling the second male portion to the female aperture portion; and a latching surface, cooperatively engaging with the latch to sealingly and releasably hold the second male portion within the female aperture portion, the latching surface having a cross section greater than the cross section of a reduced cross section of the portion of the female aperture portion.

5. The system of claim 4, further comprising:

a tube portion, sealingly coupled to the third male portion.

6. The system of claim 5, wherein the tube portion comprising one or more of a plurality of consumption attachment accessories selected from a group comprising:

a bite valve;

a straw;

a cap;

ball in the straw;

a showerhead;

a spigot; and a pet hydration attachment.

7. The system of claim 6, wherein the endpiece is kayak shaped in a plane perpendicular to the endpiece aperture.

8. The system of claim 1, wherein the second male portion and first male portion form an temperature insulating gap therebetween.

* * * * *